US007689157B2

(12) United States Patent
Tanaka

(10) Patent No.: US 7,689,157 B2
(45) Date of Patent: Mar. 30, 2010

(54) TONER CONTAINER HAVING SCREW FOR CONVEYING TONER AND IMAGE FORMING APPARATUS HAVING TONER CONTAINER

(75) Inventor: Hiroyuki Tanaka, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 335 days.

(21) Appl. No.: 11/735,072

(22) Filed: Apr. 13, 2007

(65) Prior Publication Data

US 2007/0242993 A1 Oct. 18, 2007

(30) Foreign Application Priority Data

Apr. 18, 2006 (JP) ..... 2006-113940

(51) Int. Cl.
*G03G 21/00* (2006.01)

(52) U.S. Cl. ..... 399/359

(58) Field of Classification Search ..... 399/358, 399/359, 360

See application file for complete search history.

(56) References Cited

U.S. PATENT DOCUMENTS 6,167,211 A * 12/2000 Oogi et al. ..... 399/53
7,103,308 B2 9/2006 Wakana

FOREIGN PATENT DOCUMENTS

| | | | |
|---|---|---|---|
| JP | 8-101577 | A | 4/1996 |
| JP | 11-161124 | A | 6/1999 |
| JP | 2000-172076 | A | 6/2000 |
| JP | 2005-316351 | A | 11/2005 |
| JP | 2006-098743 | A | 4/2006 |
| JP | 2006-133465 | A | 5/2006 |

* cited by examiner

*Primary Examiner*—Hoang Ngo
(74) *Attorney, Agent, or Firm*—Fitzpatrick, Cella, Harper & Scinto

(57) ABSTRACT

The invention is to improve a toner diffusing efficiency in a toner container, thereby increasing a toner containing capacity. The toner container includes plural screws which diffuse the toner in plural directions and diffuse the toner in different positions. A toner filling efficiency in the collecting container is improved by providing plural toner diffusing points within the toner container.

11 Claims, 11 Drawing Sheets

TONER CONTAINER HAVING SCREW FOR CONVEYING TONER AND IMAGE FORMING APPARATUS HAVING TONER CONTAINER

BACKGROUND OF THE INVENTION

1. Field of the Invention

The present invention relates to a toner container having a screw for conveying toner in the container, and an image forming apparatus having such a collecting container.

2. Description of the Related Art

Among the conventional image forming apparatuses utilizing toner, there is known an image forming apparatus having a toner container for recovering the toner which has been used or is no longer used in the image forming apparatus. Among such toner containers, also known is a container having a device for more efficient filling of the toner. For this purpose, for example utilized is a technology of conveying the toner to an approximately central part of the toner container thereby achieving efficient filling of the toner container.

However, in case of introducing the toner into a toner container having a large bottom area and a smaller thickness in comparison with the bottom area, the toner cannot be filled sufficiently only using such a device. Particularly in a case of handling a toner of a high cohesive property such as residual toner, it is difficult to increase the filling efficiency of the toner.

SUMMARY OF THE INVENTION

An object of the present invention is to improve a diffusion efficiency of the toner in a toner container, thereby increasing a containing ability of the toner container. Another object of the present invention is to provide a toner container including first and second screws rotated for conveying a toner in the container, wherein an axis of rotation of the second screw crosses an axis of rotation of the first screw, and the first screw conveys the toner in the container to the second screw, while the second screw includes a portion for conveying the toner in the container in a direction away from the first screw, and a portion for conveying the toner in a direction toward the first screw.

A further object of the present invention is to provide an image forming apparatus including the toner container as described above. A further object of the present invention is to provide a toner container including a screw rotated to convey a toner in the container, wherein an axis of rotation of the screw is oblique with respect to a gravitational direction, and the screw convey toner in a direction oblique and downward with respect to a gravitational direction.

A still further object of the present invention will become apparent from the following description of exemplary embodiments with reference to the accompanying drawings.

DESCRIPTION OF THE EMBODIMENTS

In the following, embodiments of the present invention will be described in an exemplary manner with reference to the accompanying drawings. However, a dimension, a material, a shape, a relative positioning and the like of components described in the following exemplary embodiments may be suitably changed depending on a construction of the apparatus in which the present invention is to be applied and on various conditions, and should not be construed to restrict the scope of the present invention thereto unless specified otherwise.

Exemplary Embodiments

Now, an image forming apparatus equipped with a toner conveying apparatus embodying the present invention will be described with reference to FIGS. 1 to 7. The description will be at first directed to an outline construction of the image forming apparatus and then to a toner conveying apparatus.

Figure 1:
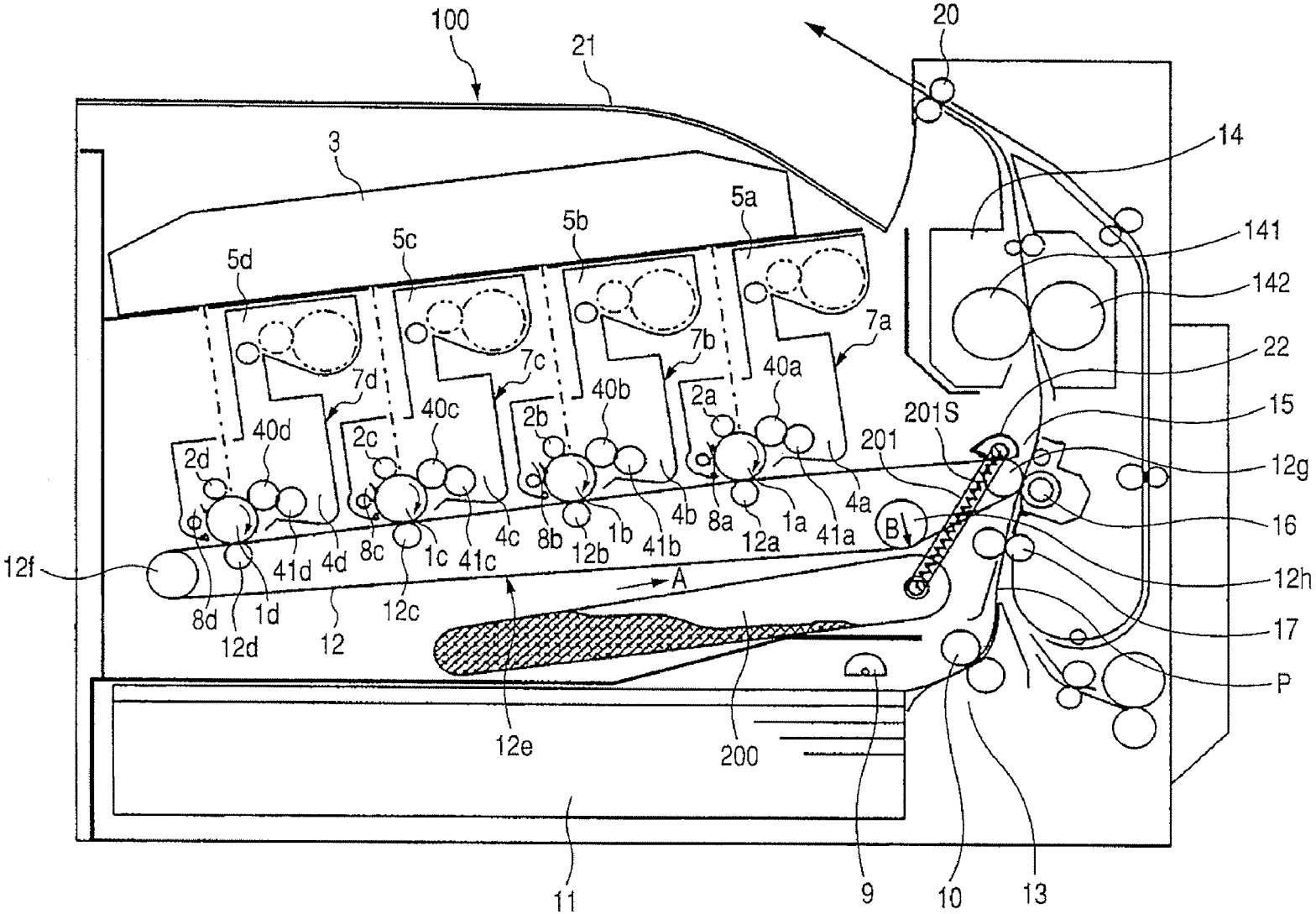
FIG. 1 is a schematic cross-sectional view of an image forming apparatus embodying the present invention.

An image forming apparatus illustrated in FIG. 1 is equipped with process cartridges 7*a*, 7*b*, 7*c* and 7*d*, which are detachably mountable on a main body 100 of the image forming apparatus. The four process cartridges 7*a*, 7*b*, 7*c* and 7*d* are similar in structure, but are different in forming images with toners of different colors, namely yellow (Y), magenta (M), cyan (C) and black (Bk). The process cartridges 7*a*, 7*b*, 7*c* and 7*d* include developing units 4*a*, 4*b*, 4*c* and 4*d*, and toner units 5*a*, 5*b*, 5*c* and 5*d*. Among these, the developing units 4*a*, 4*b*, 4*c* and 4*d* respectively include photosensitive drums 1*a*, 1*b*, 1*c* and 1*d* constituting image bearing members, charging rollers 2*a*, 2*b*, 2*c* and 2*d*, drum cleaning blades 8*a*, 8*b*, 8*c* and 8*d*, and residual toner containers. The developing units 4*a*, 4*b*, 4*c* and 4*d* further include developing rollers 40*a*, 40*b*, 40*c* and 40*d*, and toner applying rollers 41*a*, 41*b*, 41*c* and 41*d*.

Above the process cartridges 7*a*, 7*b*, 7*c* and 7*d*, a scanner unit 3 is provided for applying exposures, based on an image signal, to the photosensitive drums 1*a*, 1*b*, 1*c* and 1*d*.

The photosensitive drums 1*a*, 1*b*, 1*c* and 1*d* are charged to a prescribed negative potential by charging rollers 2*a*, 2*b*, 2*c* and 2*d*, and then electrostatic latent images are respectively formed thereon by the scanner unit 3. These electrostatic latent images are reversal developed by the developing units 4*a*, 4*b*, 4*c* and 4*d*, whereby negatively chargeable toners are deposited to respectively form Y, M, C and Bk toner images.

In an intermediate transfer belt unit 12, an intermediate transfer belt 12*e* is supported by a drive roller 12*f*, a secondary transfer backup roller 12*g* and a tension roller 12*h*. The tension roller 12*h* applies, to the intermediate transfer belt 12*e*, a tension in a direction indicated by an arrow B. Also primary transfer rollers 12*a*, 12*b*, 12*c* and 12*d* are disposed inside the intermediate transfer belt 12*e* and respectively opposed to the photosensitive drums 1*a*, 1*b*, 1*c* and 1*d*, and a transfer bias is applied by an unillustrated bias application unit.

The toner images formed on the photosensitive drums 1*a*, 1*b*, 1*c* and 1*d* are primarily transferred onto the intermediate transfer belt 12*e* in succession from the toner image on the photosensitive drum 1*a*, by a rotation of each photosensitive drum in a direction indicated by an arrow in FIG. 1, also by a rotation of the intermediate transfer belt 12 in a direction of an arrow A in FIG. 1 and by a positive bias application to the primary transfer rollers 12*a*, 12*b*, 12*c* and 12*d*, and the toner images of four colors in a superposed state are conveyed to a secondary transfer part 15.

A sheet feeding apparatus 13 includes a feed roller 9 for feeding a recording material P from a feed cassette 11 containing the recording material P, and conveying roller 10 for conveying the recording material P thus fed. Then the recording material P, conveyed from the sheet feeding apparatus 13, is conveyed by paired registration rollers 17 to the secondary transfer part 15.

In the secondary transfer part 15, a positive bias is applied to the secondary transfer roller 16, thereby secondarily transferring the four-colored toner image on the intermediate transfer belt 12*e* onto the conveyed recording material P.

The recording material P, having received the toner image transfer in the secondary transfer part 15, is conveyed to a fixing apparatus 14, and is heated and pressed by a fixing roller 141 and a pressure roller 142 whereby the toner image is fixed to the surface. The recording material P after image fixation is discharged by paired discharge rollers 20 onto a discharge tray 21.

On the other hand, toner remaining on the photosensitive drums 1*a*, 1*b*, 1*c* and 1*d* after the toner image transfers is removed by cleaning blades 8*a*, 8*b*, 8*c* and 8*d*. Also toner, remaining on the intermediate transfer belt 12*e* serving as the toner carrying member after the secondary transfer onto the recording material P, is removed by a transfer belt cleaning apparatus 22. The toner removed by the transfer belt cleaning apparatus 22 passes through a residual toner conveying path 201, and is recovered in a residual toner container 200 which constitutes a toner conveying apparatus to be described later.

Now, a detailed description will be directed to the conveyance of the toner contained in the residual toner container, constituting a toner container of the present exemplary embodiment.

Figure 2B:
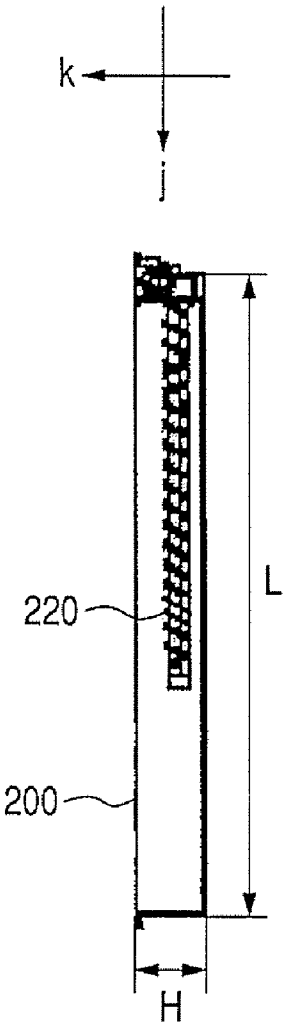
FIG. 2B is a lateral cross-sectional view of the residual toner container in an exemplary embodiment of the present invention.
Figure 2A:
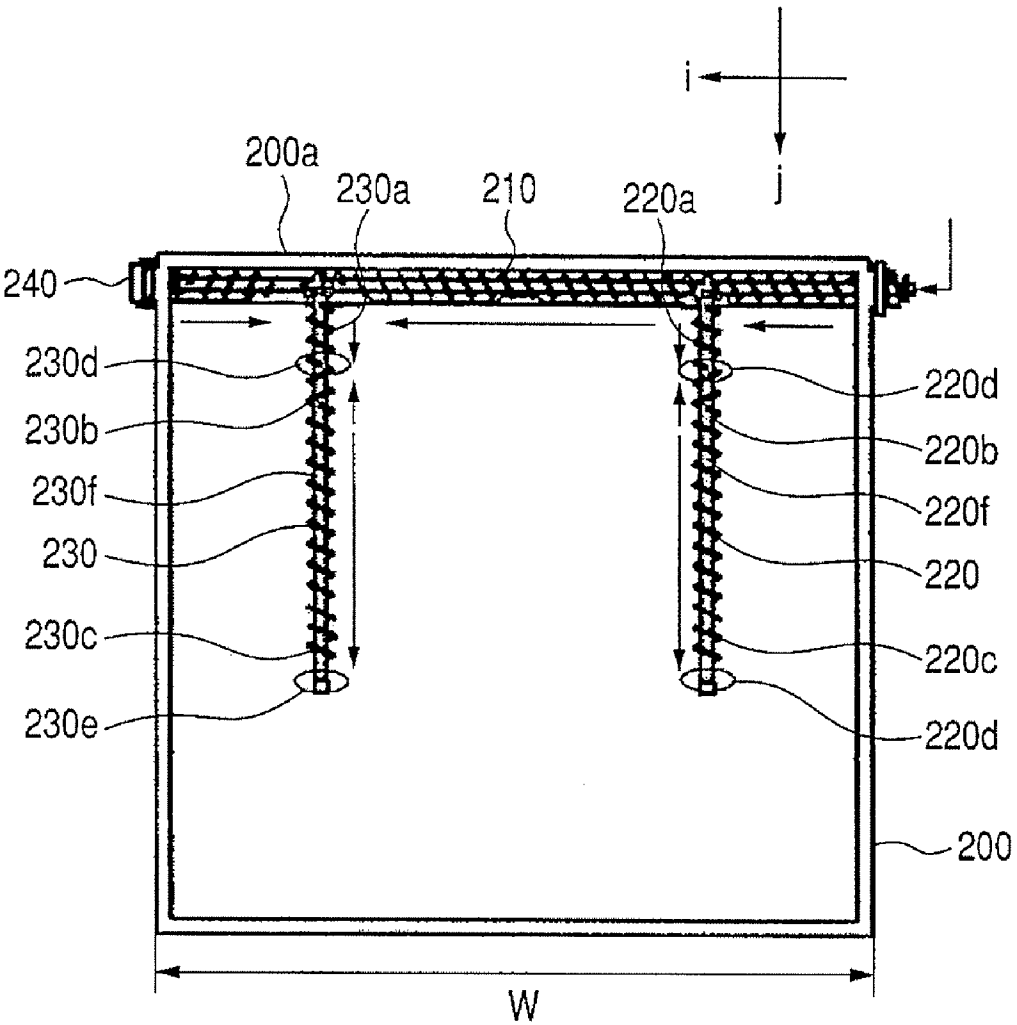
FIG. 2A is a cross-sectional plan view of a residual toner container in an exemplary embodiment of the present invention.

FIG. 2A is a cross-sectional view of the residual toner container 200 seen from above, and FIG. 2B is a cross-sectional view of the residual toner container 200 seen in a lateral direction. The residual toner container 200 is supported in an inclined state with respect to the horizontal direction, and dimensions L and W in FIG. 2A are both larger than a dimension H. Specifically, the residual toner container 200 has a flat shape with dimensions L of about 330 mm, W of about 220 mm and H of about 30 mm. In the residual toner container 200, disposed are a screw 210 as a rotary drive member, and screws 220 and 230 as toner conveying members. The screws 220 and 230 have an identical form. Each of arrows illustrated in FIG. 2A indicates a conveying direction of the toner, conveyed upon the rotation of each screw, by a spiral conveying part provided in each screw.

The screw 210 as the rotary drive member includes an axis of rotation 210*f*, rotated by a rotating force from a drive source, and a third blade 210*a*, which is disposed in a spiral form with respect to an axial direction of the axis of rotation 210*f* and serves as a third conveying part for conveying the toner. The screw 210 is so positioned, in the container 200, as to convey the toner in a direction substantially perpendicular to the toner conveying direction by the screws 220, 230 to be described later. Specifically, the screw 210 is positioned parallel with a lateral face 200*a* of the residual toner container 200 and horizontally. An end portion of the screw 210 at an entrance side for the residual toner is supported, across a metal pin, by a cover to be mounted to the residual toner conveying path 201. An end portion of the screw 210, opposite to the residual toner entrance is supported by the residual toner container 200, and supports a screw driving gear 240. The screw driving gear 240 is rotated by a driving force transmitted, through three idler gears (not shown), from a driving roller gear mounted on the drive roller 12*g*.

The screw 220 as the toner conveying member includes an axis of rotation 220*f*, rotated by a rotating force from a drive source, and a first blade 220*a*, which is disposed in a spiral form with respect to an axial direction of the axis of rotation 220*f* and serves as a first conveying part for conveying the toner. The screw 220 also includes a third blade 220*c* having a conveying direction the same as the conveying direction of the first blade 220*a*. The screw 220 further includes, between the first and third blades 220*a*, 220*c* which are disposed with a gap therebetween, a second blade 220*b* as a second conveying part for conveying the toner in a direction opposite to the toner conveying direction by the first blade 220*a* and the third blade 220*c*.

In the foregoing, a construction has been described only with respect to the screw 220 serving as the toner conveying member, but the screw 230 serving as the toner conveying member is constructed similarly as the screw 220.

The screws 220, 230 are disposed, in the container 200, in such a manner as to convey the toner in a direction which crosses the toner conveying direction of the screw 210, and are disposed substantially in parallel manner in the proximity of the bottom surface of the container 200. Specifically, these screws are disposed perpendicular to the screw 210 and parallel with the bottom face of the residual toner container 200, and are supported in the residual toner container 200 across metal pins. Also the screws 220, 230 have a length, in the toner conveying direction thereof, about a half of the dimension L of the residual toner container 200.

Figure 3:
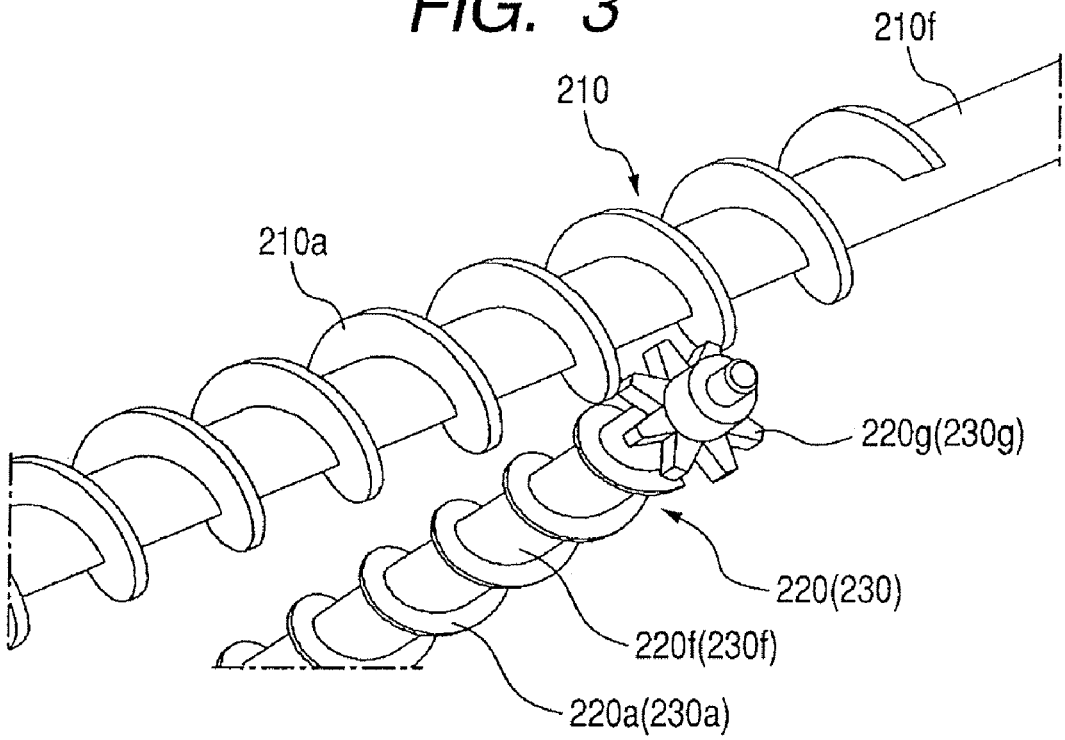
FIG. 3 is a partial perspective view illustrating a screw driving method in an exemplary embodiment of the present invention.
Figure 5:
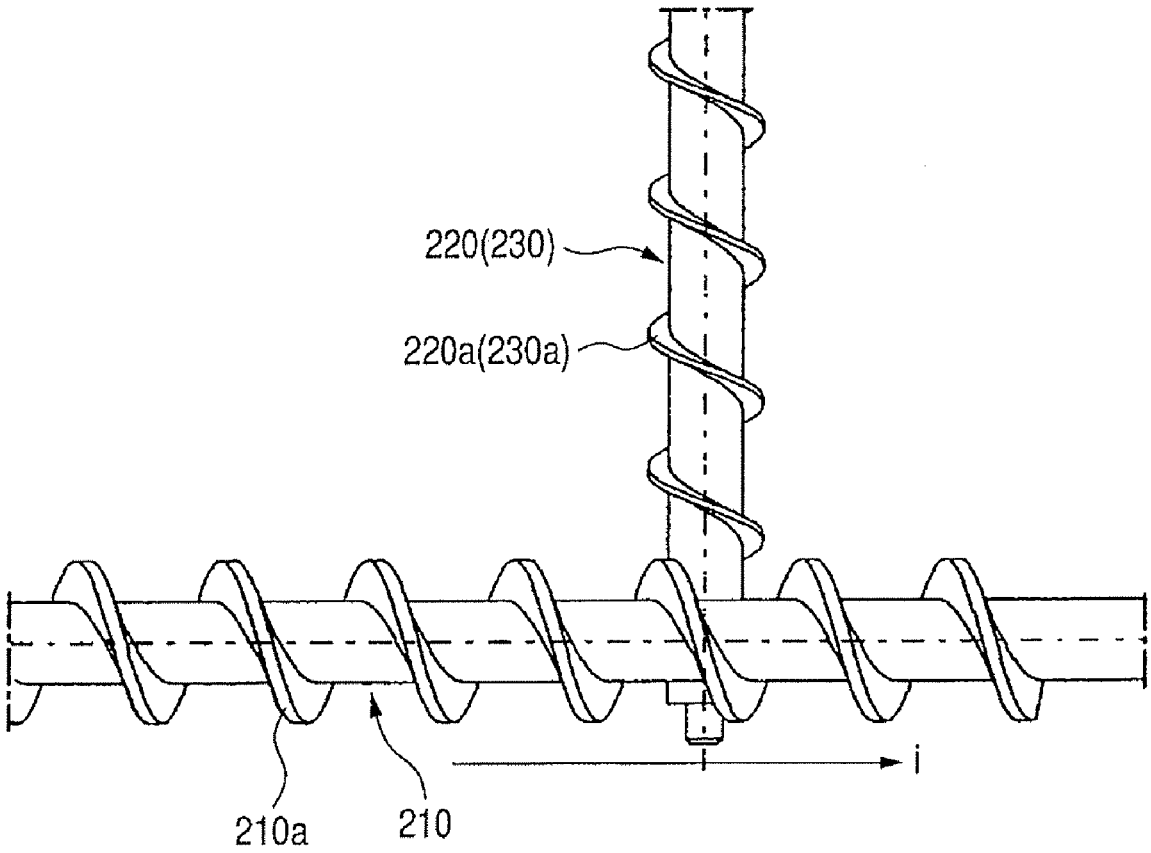
FIG. 5 is a partial plan view illustrating a screw driving method in an exemplary embodiment of the present invention.
Figure 6:
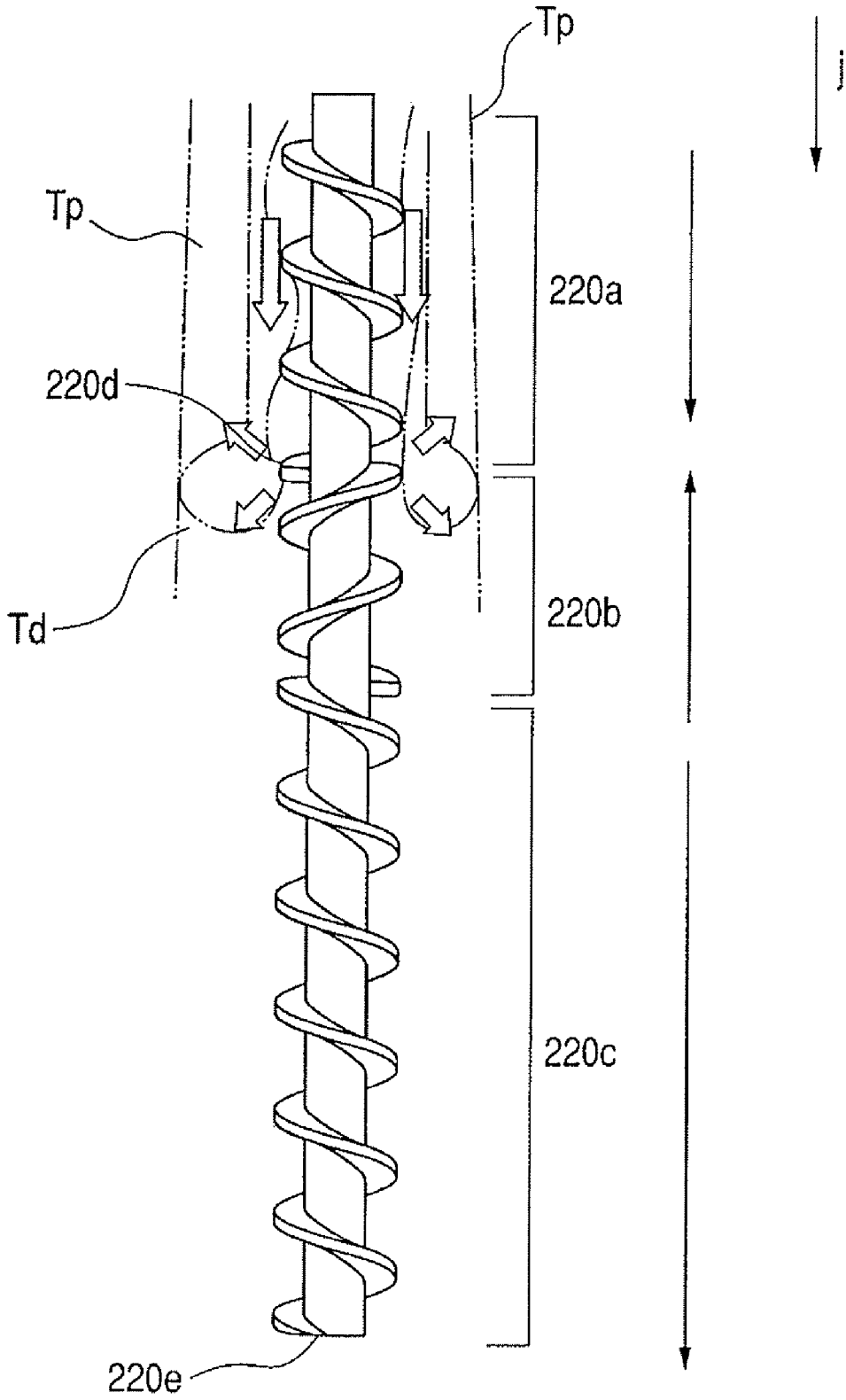
FIG. 6 is an explanatory view illustrating conveyance and diffusion states of a residual toner around a screw in an exemplary embodiment of the present invention.

Now a driving method for the screws 220 and 230 will be described with reference to FIGS. 3, 4 and 5. FIG. 3 is a perspective view of screws, while FIG. 4 is a view of the screws seen from a direction j, and FIG. 6 is a view of the screws seen from a direction k.

Figure 4:
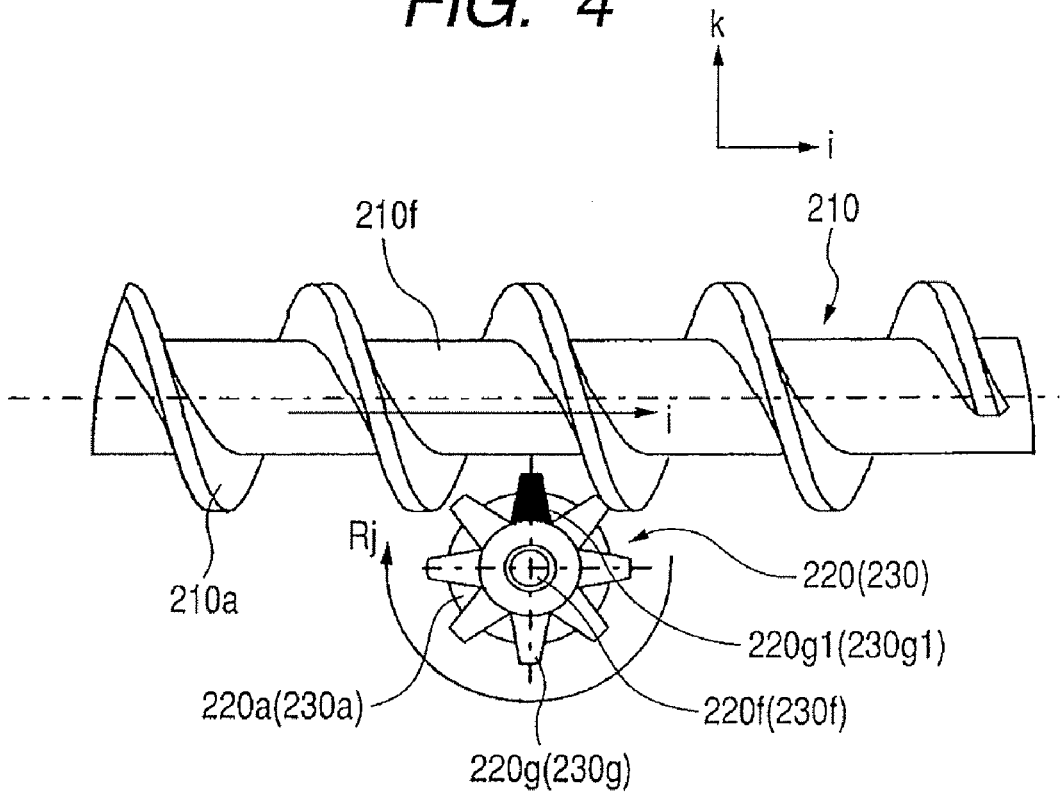
FIG. 4 is a partial lateral view illustrating a screw driving method in an exemplary embodiment of the present invention.

As illustrated in FIGS. 3 and 4, the screw 220 includes, in a portion thereof crossing with the screw 210, a protruded portion 220*g* as a drive force receiving portion for receiving a rotating force in contact with the third blade 210*a*. Therefore, the screw 220 is rotated by receiving the rotating force of the drive source from the screw 210, through the protruded portion 220*g*. Thus, the blade 210*a* of the screw 210 not only conveys the toner but also contacts the protruded portion 220*g*, provided on the end portion of the screw 220, thereby rotating the screw 220 in a direction of an arrow Rj in FIG. 4. Referring to FIG. 4, the blade 210*a* of the screw 210 rotates, in the direction Rj, a protrusion 220*g*1 in the protruded portion 220*g* at the end portion of the screw 220.

In the foregoing, a driving construction has been described only directed to the screw 220 serving as the toner conveying member, but the screw 230 serving as the toner conveying member is similarly driven as the screw 220.

As described above, the driving force is transmitted from the screw 210 to the screws 220, 230. Thus, in the residual toner container 200, the residual toner is conveyed by the screw 210 in a direction indicated by an arrow i, and then conveyed by the first blade portions 220*a*, 230*a* of the screws 220, 230 in a direction indicated by an arrow j.

Figure 7:
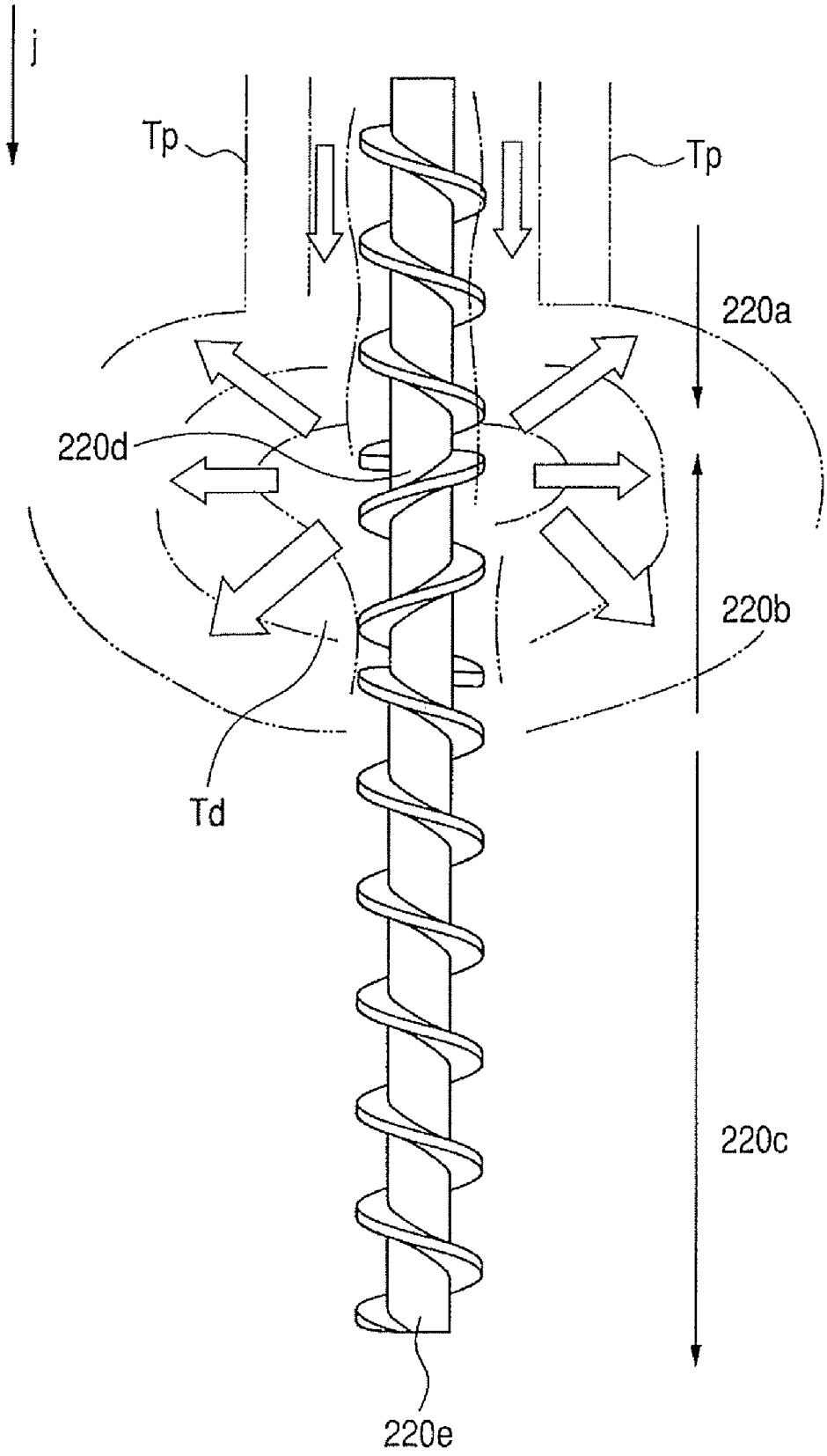
FIG. 7 is an explanatory view illustrating conveyance and diffusion states of a residual toner around a screw in an exemplary embodiment of the present invention.
Figure 8:
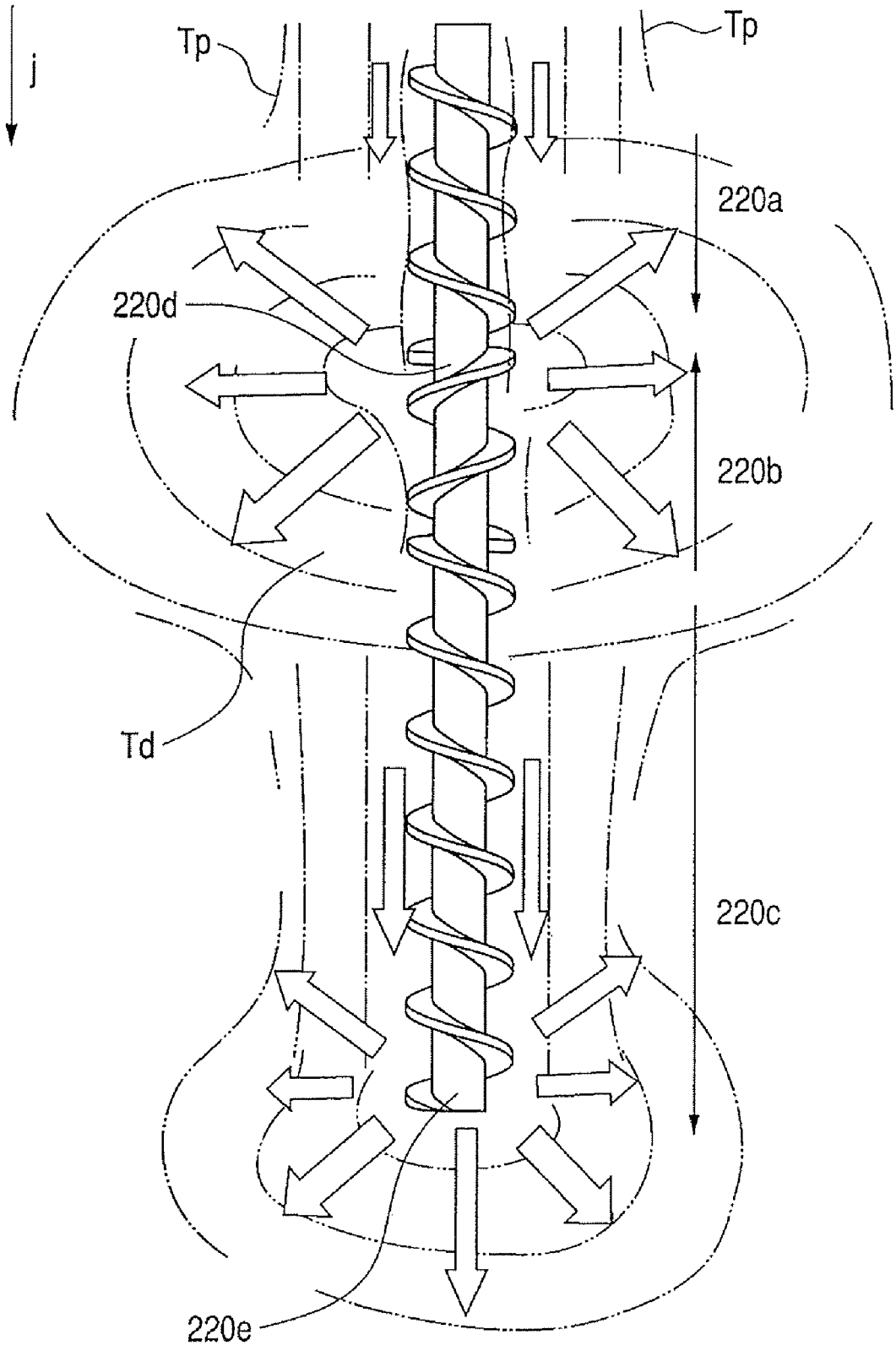
FIG. 8 is an explanatory view illustrating conveyance and diffusion states of a residual toner around a screw in an exemplary embodiment of the present invention.

Now reference is made to FIGS. 6, 7 and 8 for describing a flow of the residual toner, conveyed by the screws 220 and 230. FIGS. 6, 7 and 8 illustrate a mode of conveyance of the residual toner by the blade portions 220*a*, 220*b* and 220*c* of the screw 220. Arrows in the drawings indicate actual toner flowing directions. FIGS. 6, 7 and 8 illustrate only the residual toner flow conveyed by the screw 220, but the flow is similar also in the screw 230.

Referring to FIG. 6, the residual toner is conveyed in a direction of an arrow j by the first blade 220*a* of the screw 220, while forming a toner wall Tp in the vicinity of the screw and such toner wall Tp serving as a trough (toner conveying path) for the screw 220. The residual toner, upon reaching a boundary 220*d* between the first blade 220*a* and the second blade 220*b*, is conveyed by the second blade 220*b* in a direction opposite to the direction j. Therefore the residual toner, that has been conveyed by the blades 220*a* and 220*b*, escapes in a direction of a lower pressure and diffuses to the peripheral area around the boundary 220*d* thereby destructing the toner wall Tp, that has served as the trough in the vicinity of the screw.

With an increase of the diffused residual toner Td as illustrated in FIG. 7, the diffused residual toner Td turns around toward the second blade portion 220*b* and enters the second blade portion 220*b*, thereby being conveyed in a direction opposite to the direction j. As a result, the residual toner conveyed by the first blade 220*a* and the residual toner conveyed by the second blade 220*b* collide with each other at the boundary 220*d*, whereby the residual toner causes further diffusion. With an increase in the amount of the residual toner, the toner pressure becomes higher at the boundary 220*d* to increase the toner conveying force, whereby the residual toner diffuses over a wider area and the diffusion area of the residual toner around the boundary 220*d* becomes wider. With a spreading of the diffusion area of the residual toner by the increase in the amount of the diffused residual toner, such residual toner Td moves beyond the second blade 220*b* and reaches the blade 220*c* which conveys the toner in a direction of an arrow j.

Thereafter the residual toner is conveyed by the blade 220*c* as illustrated in FIG. 8, while forming a toner wall Tp again, in the vicinity of the screw 220, serving as a trough as described above, and is thus conveyed in the direction j, and, upon reaching the screw end 220*e* of the screw 220, diffuses to the peripheral area from the screw end 220*e*.

Figure 9:
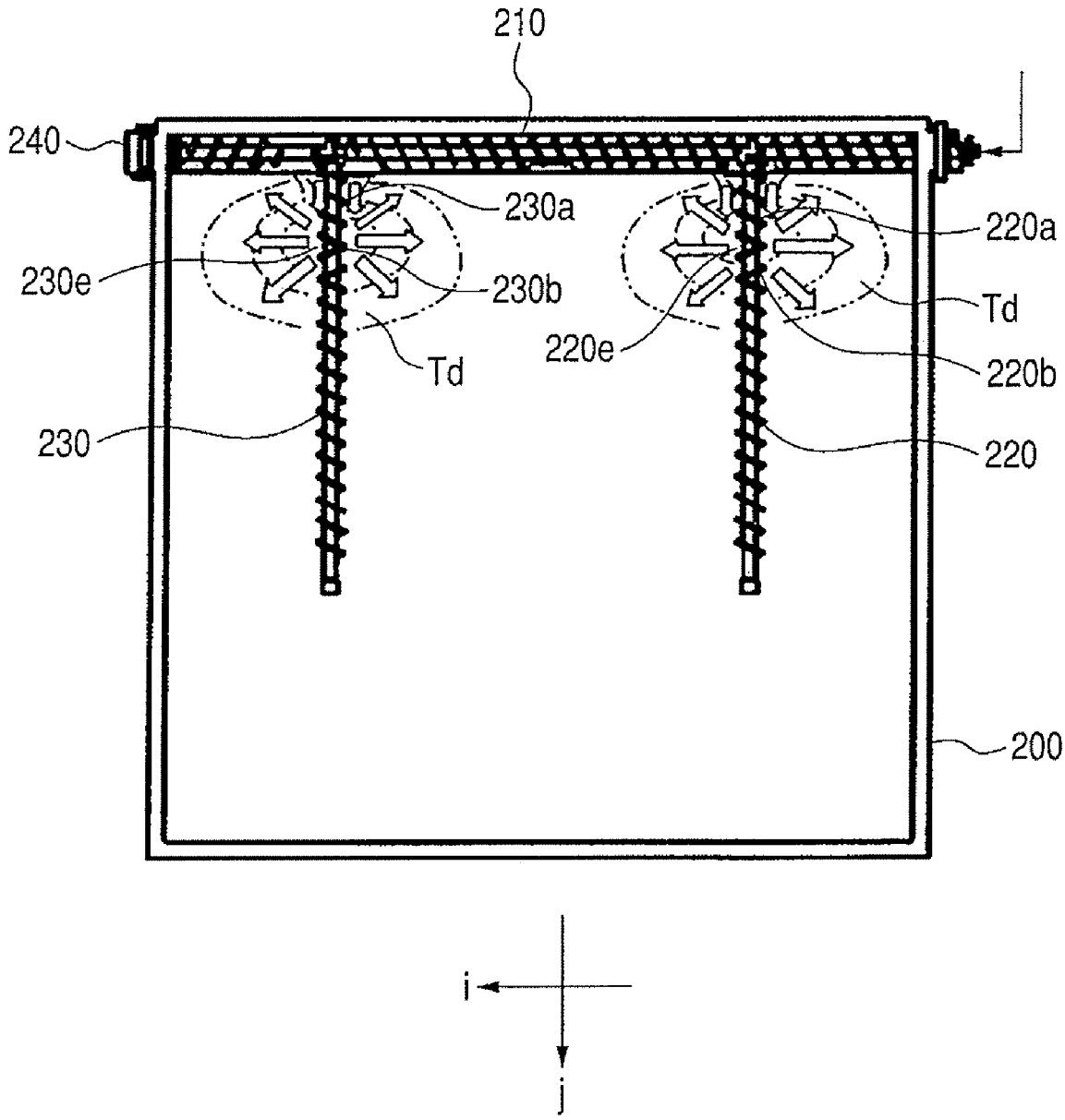
FIG. 9 is an explanatory view illustrating conveyance and diffusion states of a residual toner in a residual toner container in an exemplary embodiment of the present invention.
Figure 10:
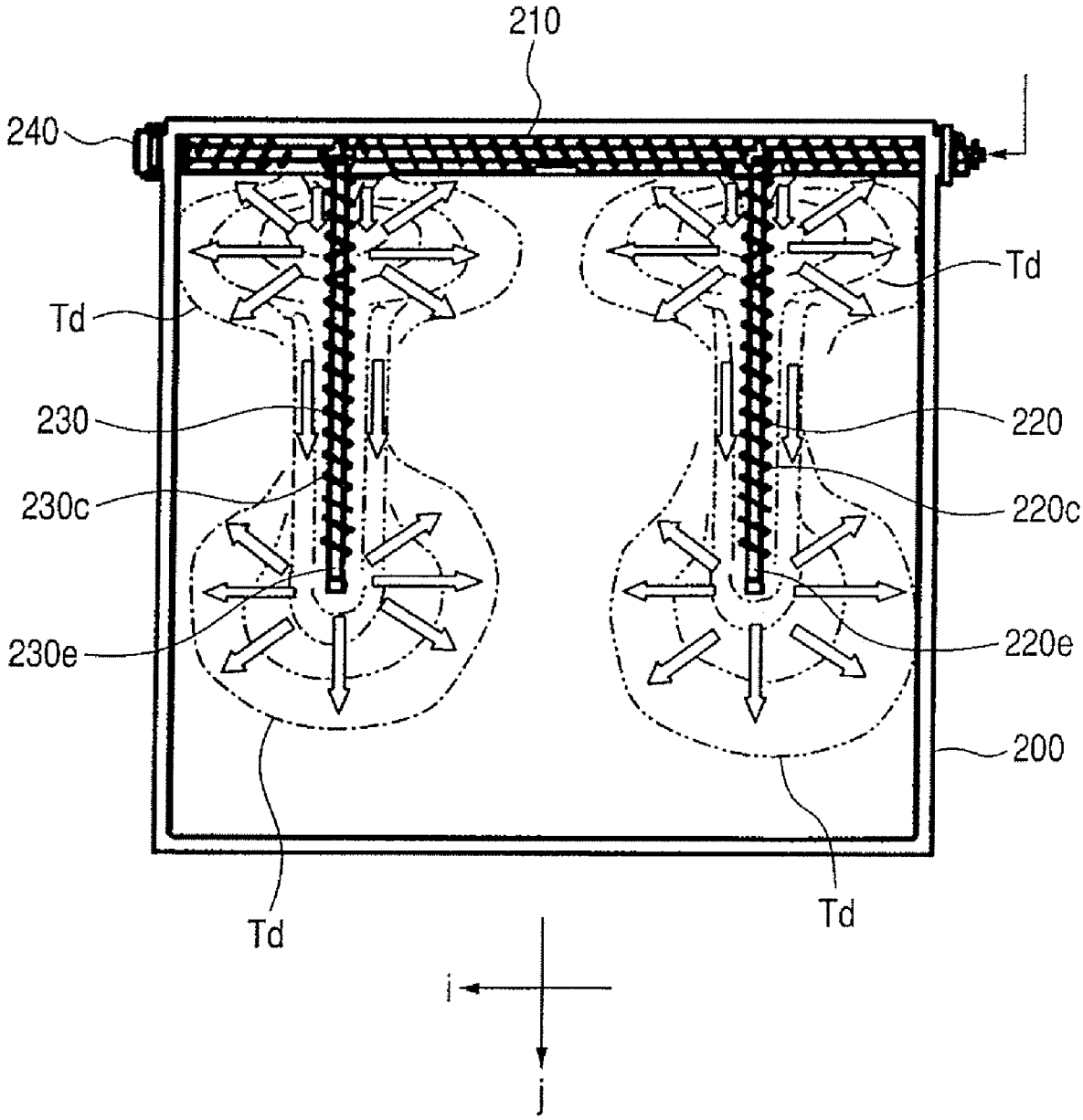
FIG. 10 is an explanatory view illustrating conveyance and diffusion states of a residual toner in a residual toner container in an exemplary embodiment of the present invention.
Figure 11:
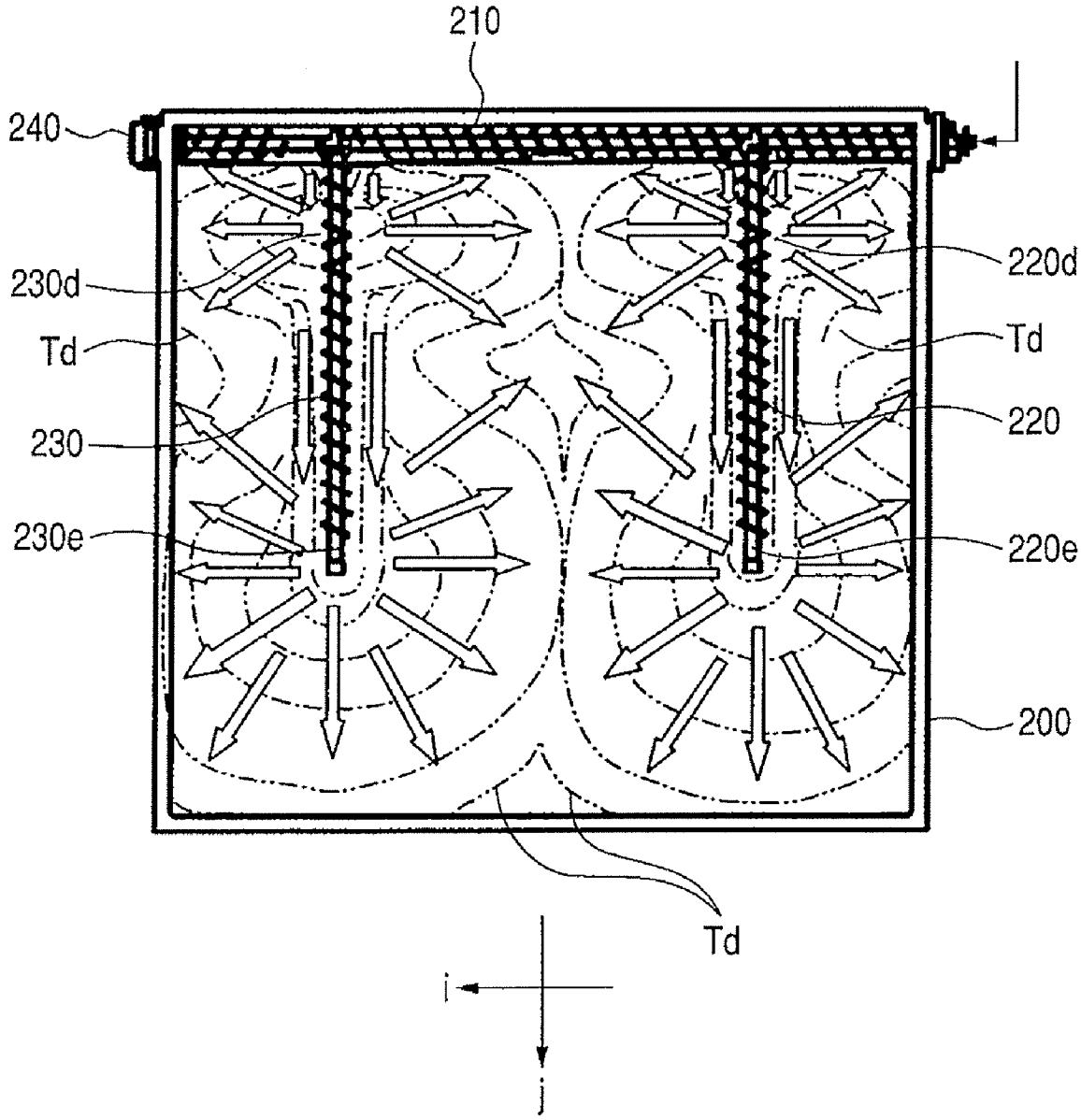
FIG. 11 is an explanatory view illustrating conveyance and diffusion states of a residual toner in a residual toner container in an exemplary embodiment of the present invention.

Now, reference is made to FIGS. 9, 10 and 11 for describing a flow of the residual toner in the residual toner container 200. FIGS. 9, 10 and 11 illustrate a mode of accumulation of the residual toner in the residual toner container. Arrows in the drawings indicate actual toner flowing directions.

As illustrated in FIG. 9, in the residual toner container 200, the residual toner conveyed by the screw 210 in a direction of an arrow i is further conveyed by screws 220, 230 crossing therewith. The residual toner, conveyed by the screws 220, 230, is conveyed in a direction j by the blades 220*a*, 230*a*, then further conveyed by the blades 220*b*, 230*b* in a direction opposite to the direction j, and diffuses from the boundaries 220*d*, 230*d*.

Thereafter, as illustrated in FIG. 10, the residual toner is further diffused by the screws 220 and 230, and thus diffused residual toner reaches the blades 220*c*, 230*c* at the most downstream side of the screws 220, 230. Then, the residual toner is conveyed by the blades 220*c*, 230*c* again in the direction j, and, upon reaching the screw ends 220*e*, 230*e*, diffuses to the peripheral area from such screw ends.

With the continued conveyance of the residual toner by the screws 210, 220 and 230, the residual toner further diffuses from four points which are the boundaries 220*d*, 230*d* and the blade ends 220*e*, 230*e* as illustrated in FIG. 11, and eventually reaches inside walls of the residual toner container 200. When the conveyance of the residual toner is further continued, the diffused residual toner fills in gaps between the screws where the residual toner is absent, and thus reaches the entire horizontal area of the residual toner container. As the boundaries 220*d*, 230*d* of the screws 220, 230 are distanced about the same from the screw 210, the residual toners diffusing from the boundaries 220*d* and 230*d* collide with each other thereby promoting the diffusion of the residual toner into the space between the screws. The diffused residual toner further piles up, thus filling the space also in the vertical direction (in the direction of dimension H of the residual toner container).

As described above, the screws 220 and 230 have the functions not only of conveying the residual toner but also of diffusing the residual toner, and such conveyance and diffusion of the residual toner enable, even in case of a flat residual toner container having a relatively small inclination angle, to fill the entire area thereof with the residual toner.

Figure 12A:
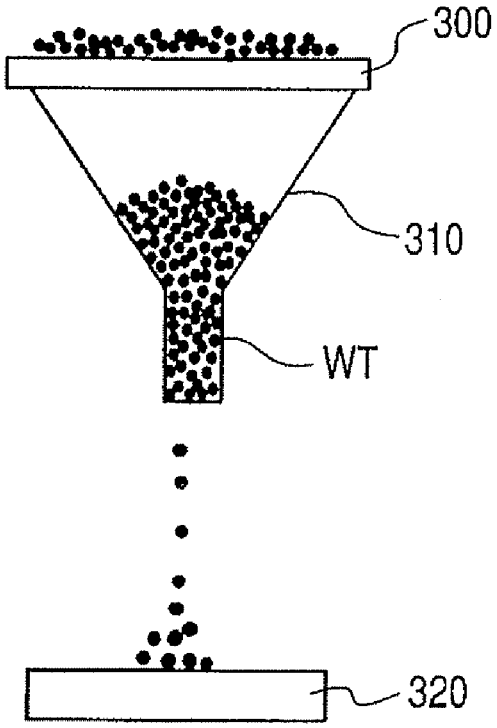
FIG. 12A and 12B are views to define an angle of repose of a toner.
Figure 12B:
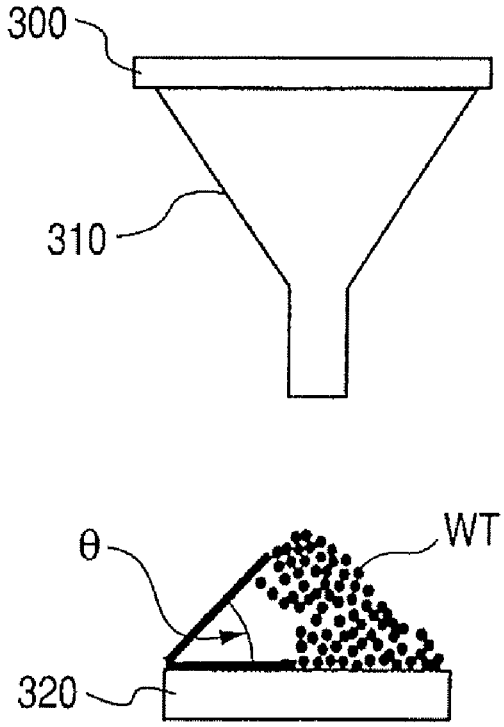

The present exemplary embodiment has explained a case where the residual toner container 200 is positioned in an inclined state, but such case is not restrictive and the above-described construction is applicable within a range of the position of the residual toner container 200 from a horizontal state to a state where it is inclined by an angle of repose of the toner. The angle of repose is within a range of from 21.6 to 34.8° when measured by a following method. As illustrated in FIG. 12, in an environment of a temperature of 23° C. and a humidity of 50%, a toner WT placed on a sieve 300 (aperture 710 μm, wire diameter ϕ450 μm) is caused to drop under vibration, and then passes through a funnel 310 (having a toner emitting hole of ϕ5 mm) placed below the sieve. Then the toner WT piles up as a heap on a measuring table 320 (circular table of ϕ80 mm) thereunder. With the piling-up of the toner WT, an angle θ illustrated in FIG. 12 gradually increases, and then becomes constant with a further piling. The angle θ in such state represents an angle of repose.

In the present exemplary embodiment, as described above, the boundaries 220*d*, 230*d* between the blades and the blade end portions 220*e*, 230*e* cause diffusion of the conveyed toner to the peripheral area. Stated differently, the screws 220, 230 have not only a function of conveying the toner but also a function of diffusing the toner. Therefore, there can be provided a toner conveying apparatus enabling a lower cost and a compactness, without increasing the number of components and without relying on a complex driving system.

Other Embodiments

The foregoing exemplary embodiment has described an application in a toner conveying system in a container for containing residual toner removed from an intermediate transfer member, but the present invention is not limited to such case. The present invention is applicable for example also to a toner conveying system in a container for containing residual toner removed from an image bearing member such as a photosensitive drum, or a toner conveying system in a toner supply apparatus for toner replenishment or in other toner containers.

Also the foregoing exemplary embodiment has described an exemplary construction in which a toner conveying member, including a first conveying part for conveying the toner in one direction and a second conveying part for conveying the toner in an opposite direction, is provided in two units in the residual toner container, but the number of such unit is not restrictive but may be suitably selected according to the necessity. Also a number and an arrangement of the first conveying part and the second conveying part within a single toner conveying member are not restricted to the form described above but may be suitably selected according to necessity.

Further, the foregoing exemplary embodiment has described an image forming apparatus utilizing four process cartridges, but such number is not restrictive and may be suitably selected according to necessity.

Further, the foregoing exemplary embodiment has described a printer as an example of the image forming apparatus, but the present invention is not limited to such case but is likewise applicable to other image forming apparatuses such as a copying apparatus and a facsimile apparatus, or a composite apparatus having such functions in combination. It is also applicable to an image forming apparatus which utilizes a recording material carrying member and in which the toner image is transferred onto a recording material carried on such recording material carrying member. The present invention can provide similar effects by applying the present invention to the toner conveying apparatus in such image forming apparatuses.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-113940, filed Apr. 18, 2006, which is hereby incorporated by reference herein in its entirety.

What is claimed is:

1. A toner container comprising:

a first screw that conveys toner by a rotation of said first screw, said first screw being provided in the container; and a second screw that conveys the toner by a rotation of said second screw, said second screw being provided in the container, wherein an axis of rotation of said second screw crosses an axis of rotation of said first screw, and said first screw conveys the toner in the container toward said second screw, wherein said second screw includes a first blade that conveys the toner in a direction in which the toner moves away from said first screw, by a one-direction rotation of said second screw, and a second blade that conveys the toner in a direction in which the toner moves toward said first screw, by the one-direction rotation of said second screw.

2. A toner container according to claim 1, further comprising:

a third screw that conveys the toner by a rotation of said third screw, said third screw being provided in the container, wherein an axis of rotation of said third screw crosses the axis of rotation of said first screw.

3. A toner container according to claim 2, wherein said third screw includes another first blade that conveys the toner in a direction in which the toner moves away from said first screw, by a one-direction rotation of said third screw, and another second blade that conveys the toner in a direction in which the toner moves toward said first screw, by the one-direction rotation of said third screw.

4. A toner container according to claim 1, wherein said second screw conveys the toner downward in a gravitational direction.

5. A toner container according to claim 1, wherein the axis of rotation of said second screw is oblique with respect to a gravitational direction, and said second screw conveys toner in a direction oblique and downward with respect to a gravitational direction.

6. A toner container according to claim 1, wherein the axis of rotation of said second screw perpendicularly crosses the axis of rotation of said first screw.

7. A toner container according to claim 2, wherein the axis of rotation of said third screw perpendicularly crosses the axis of rotation of said first screw.

8. A toner container according to claim 4, wherein said first screw conveys the toner in a horizontal direction.

9. A toner container according to claim 5, wherein said first screw conveys the toner in a horizontal direction.

10. A toner container according to claim 1, wherein said second screw comprises a gear meshing with a blade of said first screw and receives a rotary force of said first screw through meshing of said blade and said gear.

11. An image forming apparatus comprising a toner container according to claim 1, and further comprising:

an image bearing member for bearing a toner image;

an intermediate transfer belt on which the toner image is transferred from said image bearing member; and a transfer member by which the toner image is transferred from said intermediate transfer belt onto a recording material, wherein the container contains a residual toner remaining on said intermediate transfer belt after the toner image is transferred onto the recording material.

* * * * *